US012114773B2

(12) United States Patent
Pifer et al.

(10) Patent No.: US 12,114,773 B2
(45) Date of Patent: Oct. 15, 2024

(54) HARDWARE BAR ASSEMBLY

(71) Applicant: LIBERTY HARDWARE MFG. CORP., Winston-Salem, NC (US)

(72) Inventors: Kelly Nicole Pifer, Winston-Salem, NC (US); Amber Dawn Richardson, North Riverside, IL (US)

(73) Assignee: LIBERTY HARDWARE MFG. CORP., Wintson-Salem, NC (US)

( * ) Notice: Subject to any disclaimer, the term of this patent is extended or adjusted under 35 U.S.C. 154(b) by 0 days.

(21) Appl. No.: 17/898,520

(22) Filed: Aug. 30, 2022

(65) Prior Publication Data

US 2022/0408919 A1 Dec. 29, 2022

Related U.S. Application Data

(60) Division of application No. 16/827,212, filed on Mar. 23, 2020, now Pat. No. 11,445,825, which is a continuation-in-part of application No. 16/583,361, filed on Sep. 26, 2019, now Pat. No. 10,893,749.

(51) Int. Cl.
*A47B 95/02* (2006.01)

(52) U.S. Cl.
CPC ..... *A47B 95/02* (2013.01); *A47B 2095/024* (2013.01); *A47B 2095/026* (2013.01)

(58) Field of Classification Search
CPC . A47B 95/02; A47B 95/023; A47B 2095/023; A47B 2095/024; A47B 2095/026; E05B 1/00; E05B 1/0015; E05B 1/0053; E05B 85/10; E05B 79/06; F25D 23/02; F25D 23/028; F25D 2400/06; F16B 33/00; F16B 37/16

See application file for complete search history.

(56) References Cited

U.S. PATENT DOCUMENTS

| | | | |
|---|---|---|---|
| 113,398 | A | 4/1871 | Chandler |
| 320,211 | A | 6/1885 | Bergsten |
| 586,080 | A | 7/1897 | Thompson |
| 846,441 | A | 3/1907 | Ammann |
| 1,202,190 | A | 10/1916 | Kern |
| 1,276,463 | A | 8/1918 | Wells |
| 1,383,826 | A | 7/1921 | Lapham |

(Continued)

FOREIGN PATENT DOCUMENTS

| | | | |
|---|---|---|---|
| CN | 201719155 | U | 1/2011 |
| CN | 205181209 | U | 4/2016 |

(Continued)

*Primary Examiner* — Chuck Y Mah

(74) *Attorney, Agent, or Firm* — Brooks Kushman P.C.; Lora Graentzdoerffer

(57) ABSTRACT

A bar assembly is provided with a bar sized to be grasped manually with a guide formed at least partially along a length. A plurality of posts is provided, each in cooperation with the guide of the bar to fasten the bar to a support surface at various fastener mounting patterns. A method to install a bar assembly aligns a post with an aperture in a support surface. A bar is provided that is sized to be grasped manually. The bar is slid into engagement with the post. A fastener is installed to the post from an inside of the support surface. The fastener is tightened until the bar is secured in the post and the post is secured to the support surface.

20 Claims, 12 Drawing Sheets

(56) References Cited

U.S. PATENT DOCUMENTS 1,652,052 A * 12/1927 Rukenbrod ..... E05B 1/0015 16/412
2,052,606 A 9/1936 Comstock
2,066,301 A 12/1936 Plack
2,175,632 A 10/1939 Maga
2,498,139 A * 2/1950 Simjian ..... A47F 3/12 312/226
2,542,941 A * 2/1951 Post ..... A47K 10/10 248/251
2,825,469 A 3/1958 Watkins et al.
3,156,944 A 11/1964 Bohn
3,164,354 A 1/1965 Murdock
3,195,843 A 7/1965 Olbrich
3,197,803 A 8/1965 Williamson
3,484,894 A 12/1969 Fletcher
3,758,920 A 9/1973 Dobrjanskyj et al.
3,802,148 A 4/1974 Heidrich
3,812,757 A 5/1974 Reiland
3,842,564 A 10/1974 Brown
4,022,099 A 5/1977 Ballantyne
D259,753 S 7/1981 Fleischmann et al.
4,349,940 A 9/1982 Fleischmann et al.
4,524,483 A 6/1985 Lynham et al.
4,786,021 A 11/1988 Vattier
4,979,713 A 12/1990 Bell
5,026,012 A 6/1991 Wang
5,050,252 A * 9/1991 Cuttriss ..... A47K 17/022 4/576.1
5,071,099 A 12/1991 Kuo
5,186,427 A 2/1993 Semchuck
5,529,288 A 6/1996 Cheng-I
5,632,062 A * 5/1997 Katz ..... F24C 15/024 16/412
5,727,858 A * 3/1998 Shapiro ..... A47B 95/02 16/416
5,875,903 A * 3/1999 Chen ..... A47K 10/10 211/105.1
6,003,202 A 12/1999 Dauterive
6,112,344 A * 9/2000 Guenther ..... A47K 3/003 248/222.51
6,113,045 A 9/2000 Kuo
6,199,808 B1 3/2001 Lin
6,334,541 B1 1/2002 Chang
6,334,597 B1 1/2002 Ming-Hsiao
6,364,264 B1 4/2002 Lai
6,371,423 B1 * 4/2002 Miller ..... A47H 1/102 248/221.12
D472,417 S 4/2003 Hunt
6,651,830 B2 11/2003 Pan
6,796,442 B1 9/2004 Wu
6,932,328 B2 8/2005 Shreiner et al.
7,048,347 B1 5/2006 Liu
7,124,451 B2 * 10/2006 Moore ..... A47K 3/003 D6/524
D540,588 S 4/2007 Hoernig
D540,599 S 4/2007 Krumpe et al.
7,197,792 B2 4/2007 Moon
D544,269 S 6/2007 Hoernig
D576,437 S 9/2008 Krumpe et al.
7,571,532 B2 8/2009 Zimmerman
D600,961 S 9/2009 Krumpe
7,600,299 B2 10/2009 Hendrickson
D606,792 S 12/2009 Yoo
7,810,216 B2 10/2010 Zubiaurre et al.
8,070,137 B2 * 12/2011 Bennett ..... B21C 23/142 256/65.16
8,523,126 B2 9/2013 Garrels et al.
8,556,224 B2 10/2013 Kharchenko et al.
8,671,545 B1 3/2014 Zimmerman
8,813,995 B2 8/2014 Kim et al.
8,950,600 B2 2/2015 Sisto
9,220,340 B2 12/2015 Kuo
9,351,572 B2 5/2016 Kuo
D794,413 S 8/2017 Abrahams
9,883,745 B2 2/2018 Gonzales
9,909,338 B1 * 3/2018 Abrahams ..... E05B 1/0015
10,111,559 B2 10/2018 Edwards et al.
2001/0001197 A1 5/2001 Ramsey et al.
2002/0104946 A1 8/2002 Lai
2004/0160775 A1 8/2004 Goodlett et al.
2005/0194330 A1 9/2005 Ziske
2006/0175496 A1 8/2006 Lai
2007/0044275 A1 3/2007 Gurzenda
2007/0144562 A1 * 6/2007 Classen ..... A47L 15/4257 134/58 DL
2008/0258594 A1 10/2008 Giagni et al.
2009/0106942 A1 4/2009 Dell'Orfano
2009/0236299 A1 9/2009 Hall
2009/0242713 A1 10/2009 Lowe et al.
2010/0102011 A1 4/2010 Blum
2011/0179603 A1 * 7/2011 Edelen ..... A47B 95/02 16/415
2012/0145854 A1 6/2012 Smith
2013/0215381 A1 8/2013 Raghuprasad
2014/0032447 A1 1/2014 Fisher
2014/0306079 A1 10/2014 Kuo
2016/0150881 A1 6/2016 Weissenbach et al.
2017/0336020 A1 11/2017 Jones
2018/0185970 A1 7/2018 Simmons
2018/0340348 A1 * 11/2018 Simon ..... E05B 63/0056
2019/0006829 A1 1/2019 Daniels et al.
2019/0085886 A1 3/2019 Davis et al.
2019/0093821 A1 * 3/2019 Jones ..... F16M 13/02
2019/0360234 A1 * 11/2019 Alkoby ..... A47B 95/02
2021/0137321 A1 * 5/2021 Daniels ..... A47K 10/10
2021/0363779 A1 * 11/2021 Bennett ..... E05B 1/0015
2022/0316237 A1 * 10/2022 Simon ..... E05B 3/04

FOREIGN PATENT DOCUMENTS

CN 107334414 A 11/2017
CN 206603481 U 11/2017
CN 304687917 S 6/2018
CN 304950397 S 12/2018
CN 305234751 S 6/2019
CN 305279381 S 7/2019
CN 211313647 U 8/2020
EP 0678258 B1 1/1999
EP 1383367 A1 1/2004
EP 2875199 B1 * 12/2016 ..... E05B 63/0017
FR 1238431 A 8/1960
FR 1352937 A 2/1964
GB 827325 2/1960
GB 881660 11/1961
GB 982416 2/1965
JP 1577037 S 5/2017
KR 200315597 Y1 5/2003
KR 20110008876 U 9/2011

* cited by examiner

HARDWARE BAR ASSEMBLY

CROSS-REFERENCE TO RELATED APPLICATIONS

This application is a division of U.S. application Ser. No. 16/827,212 filed Mar. 23, 2020, now U.S. Pat. No. 11,445,825 B2, which is a continuation-in-part of U.S. application Ser. No. 16/583,361 filed Sep. 26, 2019, now U.S. Pat. No. 10,893,749, the disclosures of which are hereby incorporated in their entirety by reference herein.

TECHNICAL FIELD

Various embodiments relate to hardware bar assemblies for drawers or doors of cabinets, walls, or other household support surface applications.

BACKGROUND

Bar assemblies for home hardware applications, such as cabinetry, typically employ a pair of fasteners to assemble to a door or drawer. The fasteners are often spaced apart by various distances.

SUMMARY

According to an embodiment, a bar assembly is provided with a bar sized to be grasped manually with a guide formed at least partially along a length. A plurality of posts is provided, each in cooperation with the guide of the bar to fasten the bar to a support surface at various fastener mounting patterns.

According to a further embodiment, a second plurality of posts is each sized to cooperate with one of the plurality of posts to space the bar away from the support surface.

According to an even further embodiment, the fastened first plurality of posts apply compression to the second plurality of posts between the support surface and the bar or the first plurality of posts.

According to another further embodiment, the first plurality of posts is each provided with a lengthwise through aperture. The second plurality of posts are further provided with a plurality of pins. Each pin is disposed within one of the lengthwise through apertures. Each pin has a length greater than that of the corresponding first post, so that when the plurality of first posts is fastened to the support surface, the plurality of pins is under compression between the bar and the support surface.

According to an even further embodiment, each of the plurality of pins includes an enlarged surface relative to a body of the pin to contact the support surface to distribute a compression load upon the support surface.

According to another further embodiment, the second plurality of posts are further provided with a plurality of sleeves, each sized to receive one of the plurality of posts.

According to an even further embodiment, the plurality of sleeves each include a radially asymmetrical bore formed therethrough. The posts each have a corresponding radially asymmetrical profile sized to extend through the bores in the sleeves and prevent rotation of the sleeves relative to the posts.

According to another further embodiment, a plurality of fasteners is sized to engage a body of each of the plurality of posts to fasten the bar to the support surface.

According to an even further embodiment, the plurality of fasteners tightens the posts against the bar to lock the posts along the guide.

According to an even further embodiment, a plurality of sleeves is provided, each sized to receive a body of one of the plurality of posts to space the bar away from the support surface. Upon installation of the plurality of fasteners, the plurality of posts is under tension and the plurality of sleeves are under compression, to thereby lock the plurality of posts along the guide.

According to another even further embodiment, the body of each of the plurality of posts is internally threaded. Each of the plurality of fasteners is externally threaded and sized to be received in the internally threaded bodies of the plurality of posts.

According to an even further embodiment, the plurality of posts is each further provided with a head that is connected to, and enlarged, relative to the body. The guide is formed as a slot with a width sized to receive the heads of the plurality of posts. The width of the slot is consistent along a depth of the slot. A retainer is attached to the bar and sized to engage the heads of the plurality of posts to retain the plurality of posts to the bar. The retainer has a slot formed therethrough and sized to permit the bodies of each of the plurality of posts to pass through the retainer.

According to another further embodiment, the bar is provided with a body. The guide is formed along the body. A grip portion is sized to extend from the body and is sized to be grasped manually.

According to another further embodiment, the plurality of posts is each further provided with a body and a head that is connected to, and enlarged relative to the body. The guide is further defined as a slot with a narrow region formed into the bar to permit the plurality of posts to pass into the bar, and an enlarged region intersecting the narrow region and sized to receive the head of each of the plurality of posts.

According to an even further embodiment, the head of each of the plurality of posts is formed with at least a pair of opposed flats sized to be received within the enlarged region of the slot. The enlarged region of the slot is sized to prevent rotation of each of the plurality of posts.

According to another further embodiment, the guide is further defined as a consistent cross section formed along the length of the bar. A plurality of collars is provided, each affixed to a distal end of one of the plurality of posts. Each collar is sized to receive the cross section of the bar therein for linear adjustment of the plurality of collars relative to the bar.

According to an even further embodiment, a plurality of sleeves is provided, each sized to receive a body of one of the plurality of posts to space the bar away from the support surface. The plurality of sleeves engages the bar to limit translation of the bar relative to the collars after installation.

According to an even further embodiment, an aperture is formed through each collar adjacent the post. A plurality of retainers is provided, each extending from one of the plurality of sleeves through the corresponding aperture to engage the bar.

According to another embodiment, a bar assembly is provided with a bar sized to be grasped manually with a guide formed at least partially along a length of the bar. A plurality of posts is each in cooperation with the guide of the bar to fasten the bar to a support surface at various fastener mounting patterns. A plurality of sleeves is each sized to receive a body of one of the plurality of posts to space the bar away from the support surface. A plurality of fasteners is each sized to engage a body of one of the plurality of posts to fasten the bar to the support surface. Upon installation of the plurality of fasteners, the posts are under tension and the sleeves are under compression, to thereby lock the posts along the guide.

According to a further embodiment, the guide is further defined as a consistent cross section formed along a length of the bar. A plurality of collars is each affixed to a distal end of one of the plurality of posts. Each collar is sized to receive the cross section of the bar therein for linear adjustment of the plurality of collars relative to the bar.

According to an even further embodiment, the consistent cross section is shaped to prevent rotation of the bar relative to the plurality of posts.

According to an even further embodiment, an aperture is formed through each collar adjacent the post. A plurality of retainers extends from one of the plurality of sleeves through the aperture to engage the bar.

According at least another embodiment, a method to install a bar assembly aligns a post with an aperture in a support surface. A bar is provided that is sized to be grasped manually. The bar is slid into engagement with the post. A fastener is installed to the post from an inside of the support surface. The fastener is tightened until the bar is secured in the post and the post is secured to the support surface.

According to a further embodiment, a bar assembly with at least one fastener is removed from the aperture in the support surface before aligning the post with the aperture.

According to another further embodiment, a sleeve is installed upon the post in engagement with the bar and the support surface.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Handle assemblies typically employ a pair of fasteners to assemble to a door or drawer of household cabinetry and the like. The fasteners are often spaced apart by various distances. However, handles wear and fail over time and require replacement. It can become difficult to find replacement handles for various handle fastener mounting patterns. It may be difficult to procure replacement handles that match and mount to various mounting patterns that may be utilized on a common piece of cabinetry or furniture.

FIGS. 1-4 illustrate a drawer 10 from a household cabinet with a handle assembly 12 that is not limited to a singular mounting pattern. The handle assembly 12 is a cabinet drawer pull with an adjustable center-to-center mounting distance for use on cabinets and/or furniture, including those with non-standard, pre-drilled holes. The handle assembly 12 may be utilized on new installations or utilized to replace handle assemblies on existing cabinetry or furniture.

Figure 1:
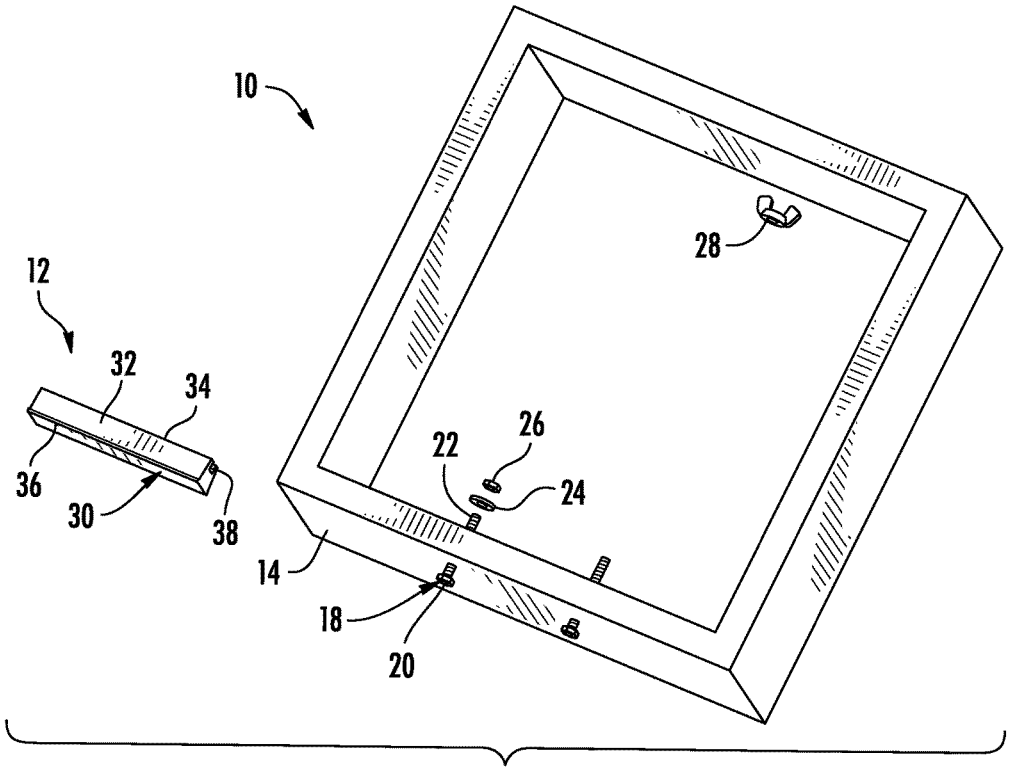
FIG. 1 is a partially exploded top perspective view of a drawer with a handle assembly according to an embodiment.
Figure 2:
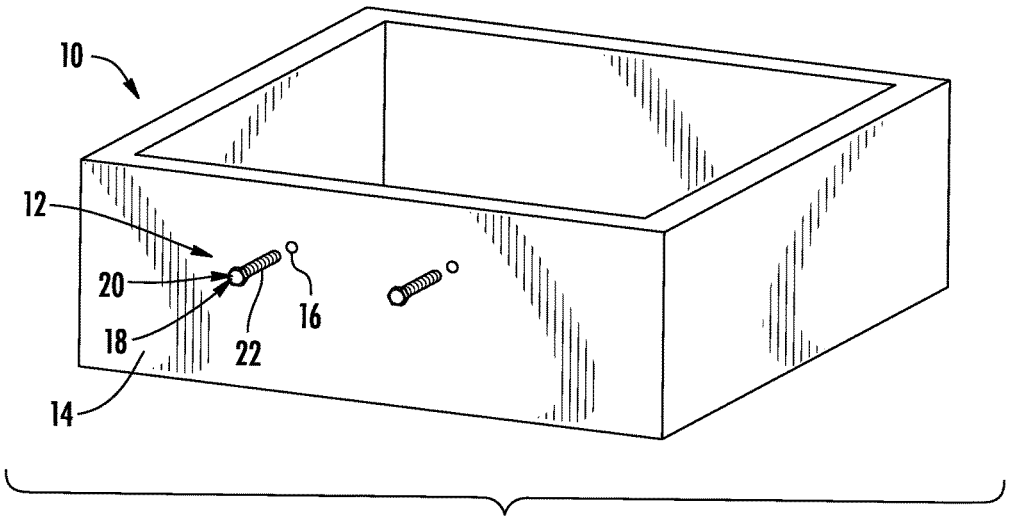
FIG. 2 is an exploded front perspective view of the drawer and the handle assembly of FIG. 1.

FIGS. 1-4 illustrate the handle assembly 12 in various installation steps. FIG. 1 illustrates the handle assembly 12 partially disassembled to illustrate the various components. FIG. 2 illustrates a front surface 14 of the drawer 10. The drawer front surface 14 includes a pair of apertures 16 formed through a thickness of the front surface 14. The apertures 16 may have been provided in an existing drawer 10 with a prior handle assembly, whereby the handle assembly 12 is a replacement. In this case, the prior handle assembly is removed before installing the handle assembly 12. Alternatively, the apertures 16 may be predrilled in a new drawer 10 for attachment of the handle assembly 12. The apertures 16 may also be drilled at the time of installation of the handle assembly 12.

A pair of first fasteners, bolts 18 are each inserted into one of the apertures 16 with a head 20 of the bolt 18 on the front surface 14 of the drawer 10, and an externally threaded shank 22 extending through the aperture 16 and into the drawer 10. The handle assembly 12 may be packaged with various bolts 18 with varying shank 22 lengths or diameters to accommodate drawers 10 of varying thicknesses with apertures 16 of varying diameters.

Referring again to FIG. 1, a plurality of second fasteners are attached to the threaded shanks 22 of the bolts 18. A flat washer 24 is placed upon each of the threaded shanks 22. A pair of internally threaded nuts, such as a hex nut 26 or a wing nut 28 is loosely installed upon each shank 22 within the drawer 10. Both the hex nut 26 and the wing nut 28 are depicted in FIG. 1 to illustrate two of the nut options. The hex nut 26 and the wing nut 28 are not yet tightened. Alternatively, instead of the wing nut 28, item 28 may be provided as a wing wrench 28 with an internal socket sized to receive the hex nuts 26 to manually tighten the hex nuts 26.

Figure 3:
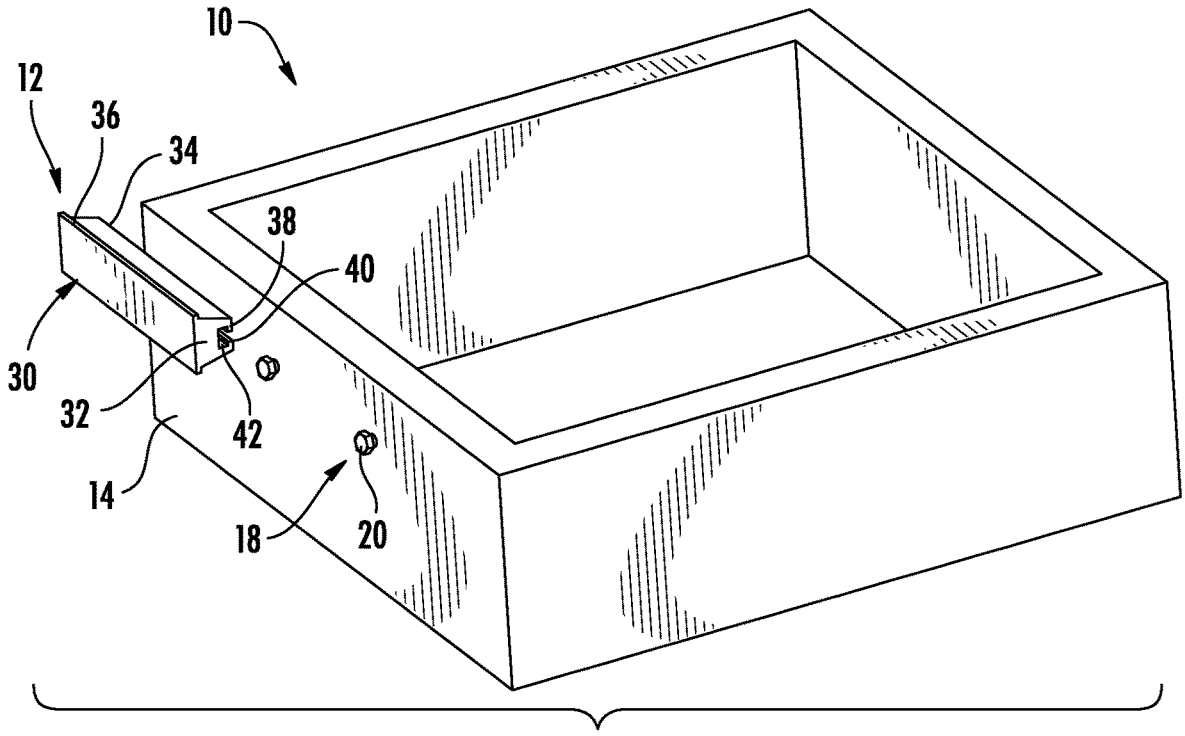
FIG. 3 is a partially exploded perspective view of the drawer and the handle assembly of FIG. 1.
Figure 4:
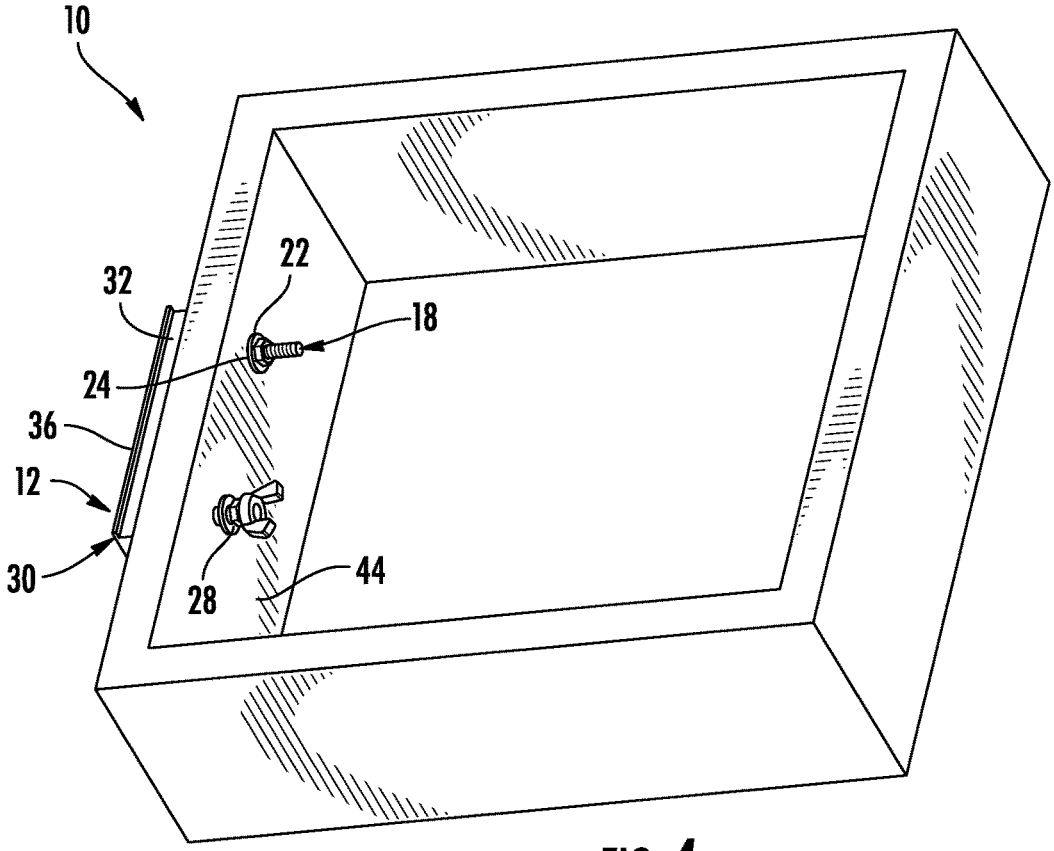
FIG. 4 is a top perspective view of the drawer and the handle assembly of FIG. 1.

Referring to FIGS. 1, 3 and 4, the handle assembly 12 includes a handle 30 to be installed upon the bolts 18. The handle 30 includes a body 32 with a flat mounting surface 34 to engage the front surface 14 of the drawer 10. A grip portion 36 is formed upon the body 32 spaced apart from the handle mounting surface 34 to be grasped and pulled by a user.

Referring to FIGS. 1 and 3, a slot 38 is formed along a length of the body 32 of the handle 30 to receive the heads 20 of the bolts 18. The slot 38 includes a narrow region at an opening 40 through the mounting surface 34. Referring now to FIG. 3, the opening 40 permits the shanks 22 of the bolts 18 to pass into the body 32 of the handle 30. The slot 38 also includes an enlarged region 42 intersecting with the opening 40. The enlarged region 42 is sized to receive the heads 20 of the bolts 18. The slot 38 is often referred to as a 'T-slot' or a 'T-shaped slot' due to the perpendicular intersection of the enlarged region 42 and the narrow opening 40.

The handle 30 may be formed from any suitable material, such as metal, wood, plastic, composite, or the like. The handle 30 may be extruded with a consistent cross-section.

As illustrated in FIG. 3, the handle 30 is slid onto the bolts 18 so that the heads 20 of the bolts 18 are received in the enlarged region 42 of the slot 38. The user can center the body 32 of the pull handle 30 as desired. Next, and with reference to FIG. 4, the user tightens the inside fasteners, hex nut 26 or wing nut 28, so that the pull handle 30 is held in place by a tensile force of the bolts 18 distributed inside face the slot 38 of the handle body 32 and a back face 44 of the drawer 10. The bolt heads 20 are formed with an array of wrench flats, such as a hex head 20 of the bolts 18. The enlarged region 42 of the slot 38 is sized to receive the hex heads 20 of the bolts 18 for translation therein, while preventing rotation of the hex heads 20, and consequently the bolts 18. Therefore, as the user tightens the inside fasteners 26, 28, the bolts 18 are tightened without requiring an additional tool or wrench. Friction of the loaded fasteners 18 within the handle slot 38 prevent side to side movement of the pull handle 30.

The handle assembly 12 offers adjustable center-to-center capability and efficient installation compared to prior art handle assemblies due to the channel 38 in the body 32 of the pull handle 30. Prior art designs provide adjustable posts that require the user to fix the center-to-center distance on the posts of the handle pull prior to installation, by use of set screws and other methods. The unitary handle 30 design eliminates adjustable posts, which can be difficult to align. The handle assembly 12 permits the user to start with the bolts 18 in the existing holes 16, and simply slide the pull handle 30 over the bolt heads 20 regardless of the spacing of the bolts 18. The handle assembly 12 may be employed in various mounting patterns of apertures 16 without requiring any adjustment to the handle 30.

Figure 5:
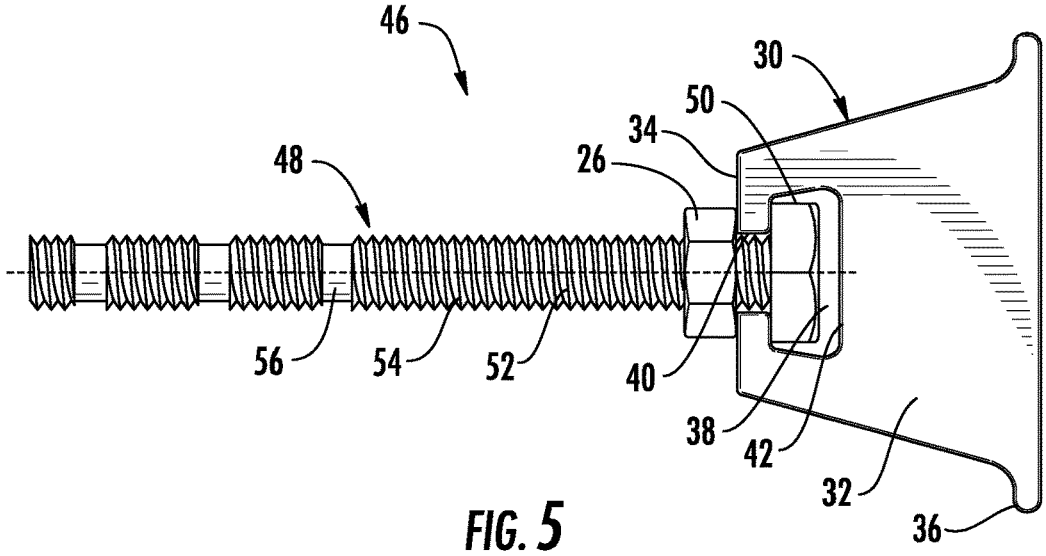
FIG. 5 is a side elevation view of a handle assembly according to another embodiment.

FIG. 5 illustrates a handle assembly 46 according to another embodiment. The handle assembly 46 is similar to the prior embodiment, with the handle 30, with the body 32 with the slot 38 formed therein along the length. The slot 38 includes the narrow opening 40 formed through the mounting surface 34 and intersecting the enlarged slot region 42. The handle 30 is provided with the grip portion 36 spaced apart from the mounting surface 34. A plurality of breakaway hex bolts 48 are provided with a hex head 50 to be received in the enlarged slot region 42. A shank 52 extends through the slot opening 40 with a length to address a plurality of standard drawer and door thicknesses. The shank 52 includes a plurality of threaded regions 54 to receive the nut 26 at various locations, each associated with a standard drawer or door thickness. The shank 52 also includes a plurality of unthreaded regions 56 to permit the user to break the bolt 48 to shorten the bolt 48 and remove an unused portion of the shank 52.

Figure 6:
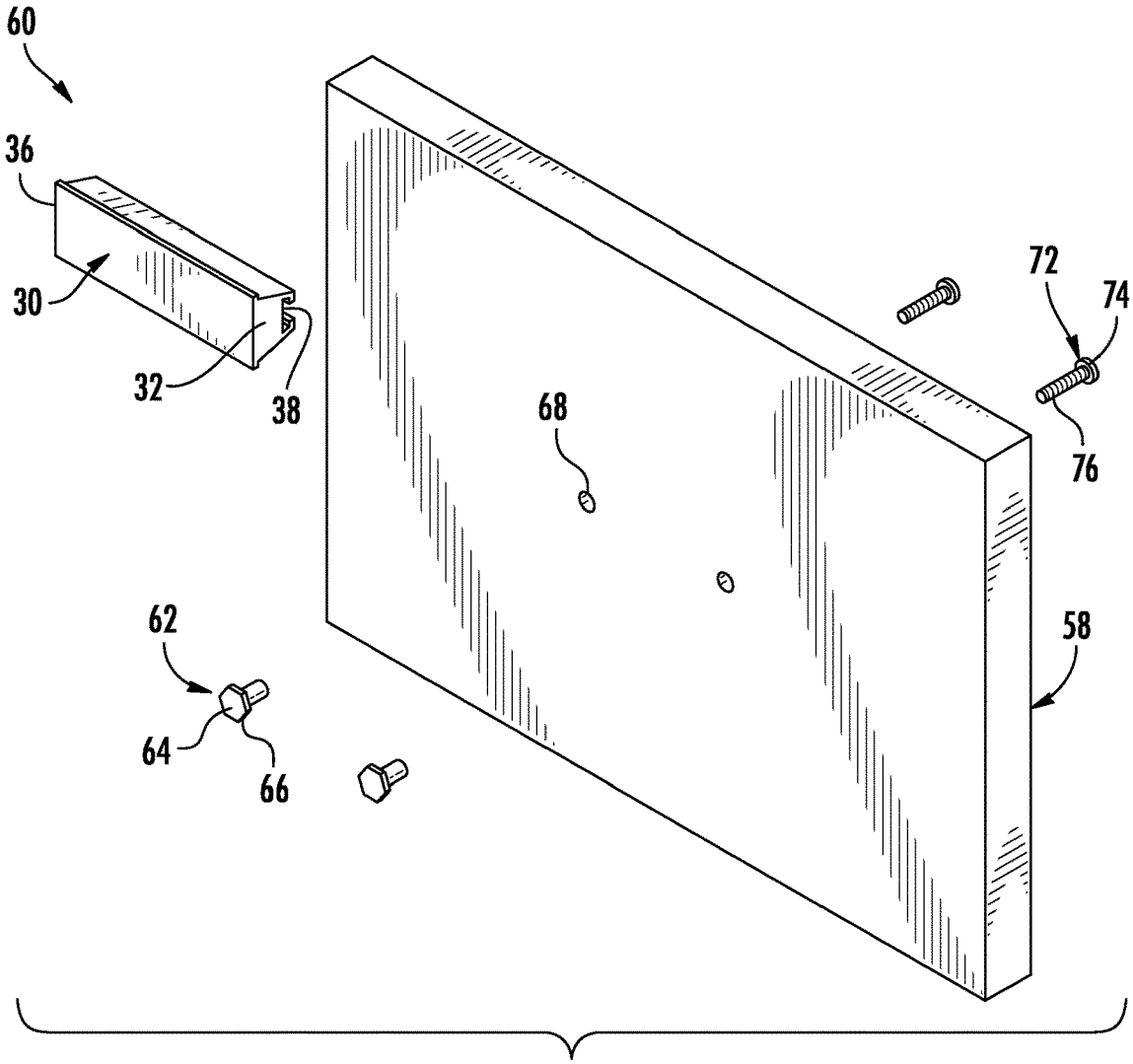
FIG. 6 is an exploded front perspective view of a door with a handle assembly according to another embodiment.
Figure 7:
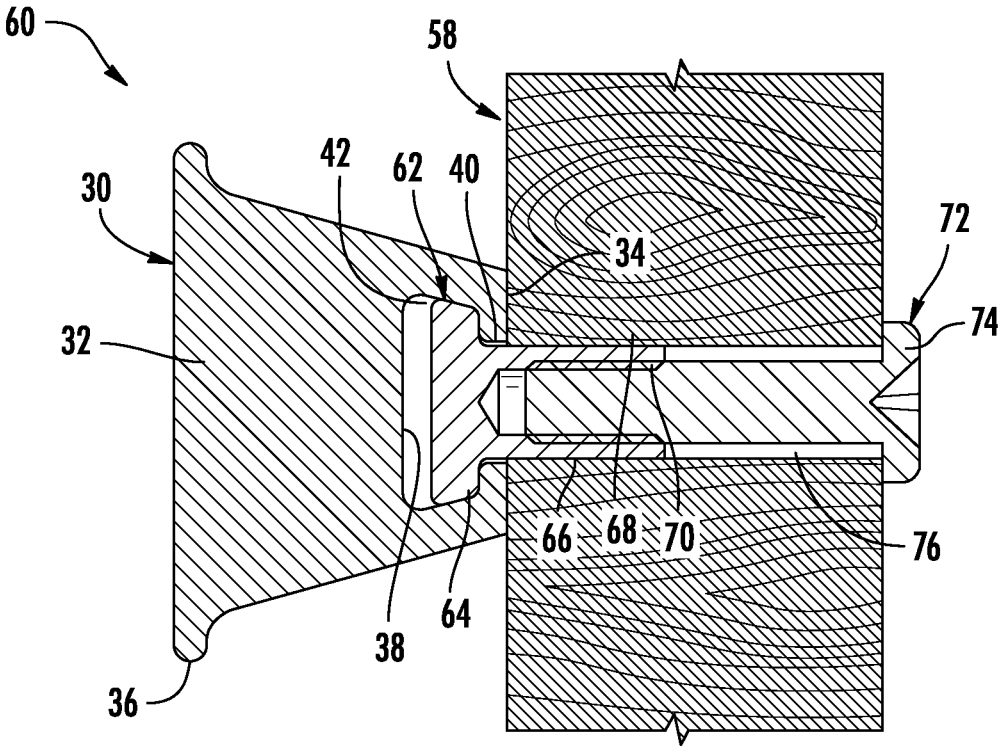
FIG. 7 is a side section view of the door with the handle assembly of FIG. 6.

FIGS. 6 and 7 illustrate a door 58 of a cabinet of furniture. A handle assembly 60 is provided according to another embodiment. The handle assembly 60 is similar to the prior embodiments, with the handle 30, with the body 32 with the slot 38 formed therein along the length. The slot 38 includes the narrow opening 40 formed through the mounting surface 34 and intersecting the enlarged slot region 42. The handle 30 is provided with the grip portion 36 spaced apart from the mounting surface 34.

The handle assembly 60 includes a pair of internally threaded fasteners 62 according to another embodiment. The fasteners 62 may include a hex head 64 sized to be received in the enlarged region 42 of the handle slot 38. A shank 66 extends from the hex head 64 and is sized to extend through the opening 40 of the handle slot 38 and partially into one of a pair of mounting apertures 68 in the door 58. The shank 66 of the fasteners 62 includes a blind depth, internally threaded aperture 70 as illustrated in FIG. 7.

During assembly, the hex nut shanks 66 are installed in the mounting apertures 68, and then the handle 30 is slid over the hex heads 64 into the slot 38. A pair of machine screws 72 are provided to be inserted into the apertures 68 of the door 58 at an inside of the door 58. The screws 72 include a head 74 to engage the inside of the door 58. The screws 72 also include an externally threaded shank 76 sized to extend into the aperture 68 of the door 58 and into threaded engagement with the internally threaded apertures 70 of the fasteners 62. The fasteners 62 are constrained from rotation within the slot 38. The machine screws 72 are tightened to secure the handle assembly 60 to the door 58.

Figure 8:
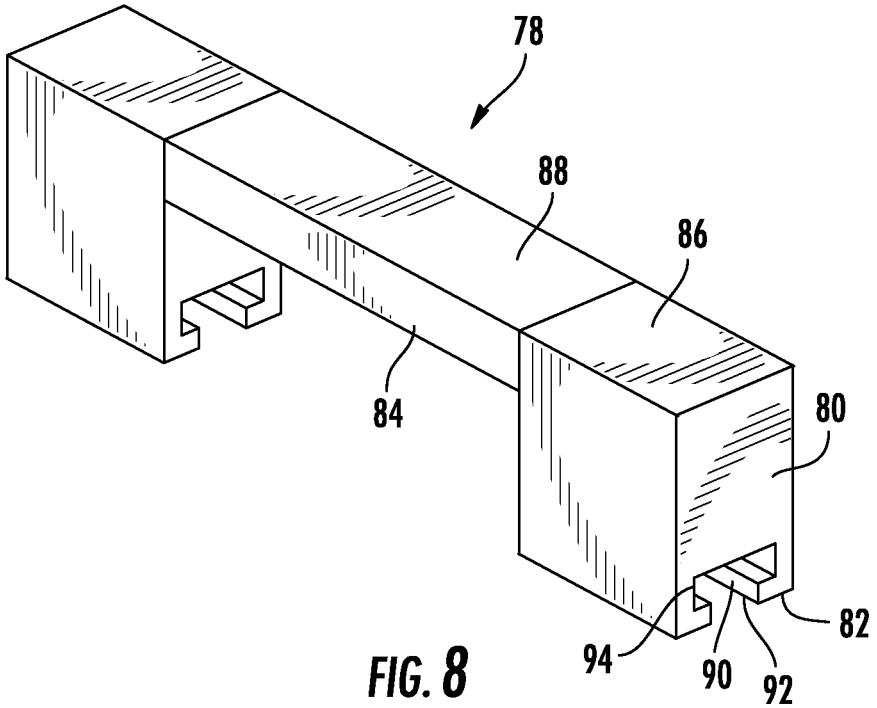
FIG. 8 is a perspective view of a handle according to another embodiment.

FIG. 8 illustrates a handle 78 according to another embodiment. The handle 78 includes a body 80 with a mounting surface 82 to be mounted to a drawer or door. An opening 84 is formed through the body 80 and intersecting the mounting surface 82 to divide the body 80 into a pair of spaced apart body portions 86 and a central grip portion 88. Similar to the prior embodiments, a slot 90 is formed lengthwise through the body 80 and extending through both body portions 86. The slot 90 includes an opening 92 for passage of a fastener shank and an enlarged portion 94 for receipt of a fastener hex head. The body portions 86 are sized laterally to provide a range of mounting aperture patterns. The body portions 86 act as handle posts but are static and are not adjustable relative to the grip portion 88.

Figure 9:
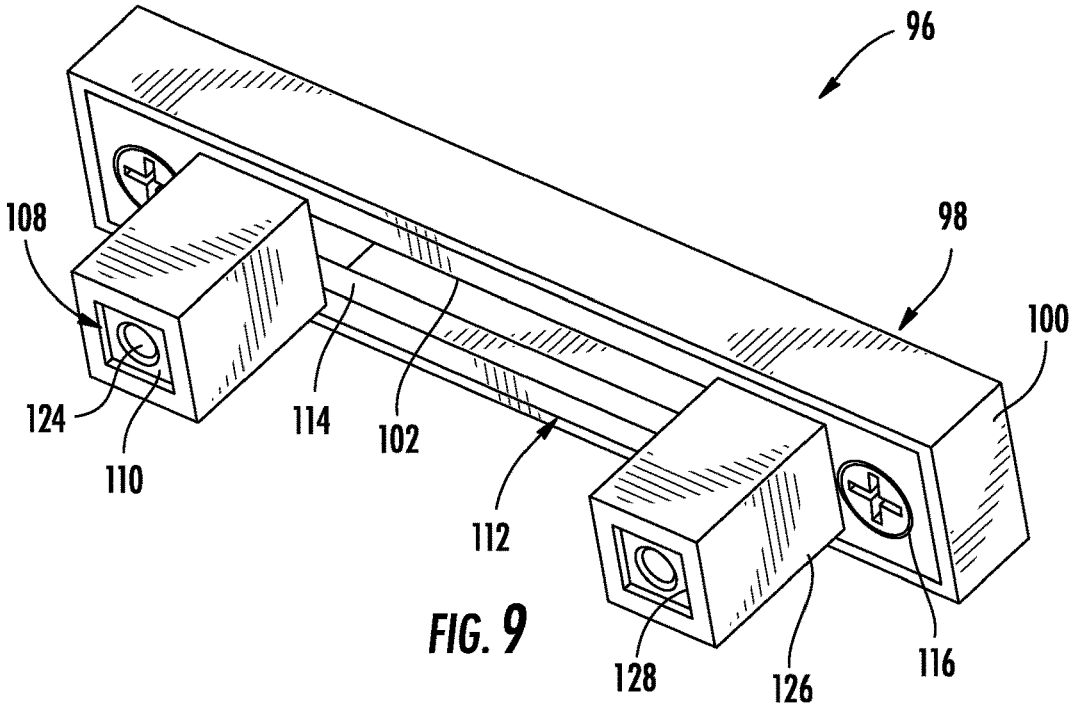
FIG. 9 is a rear perspective view of a handle assembly according to another embodiment.
Figure 10:
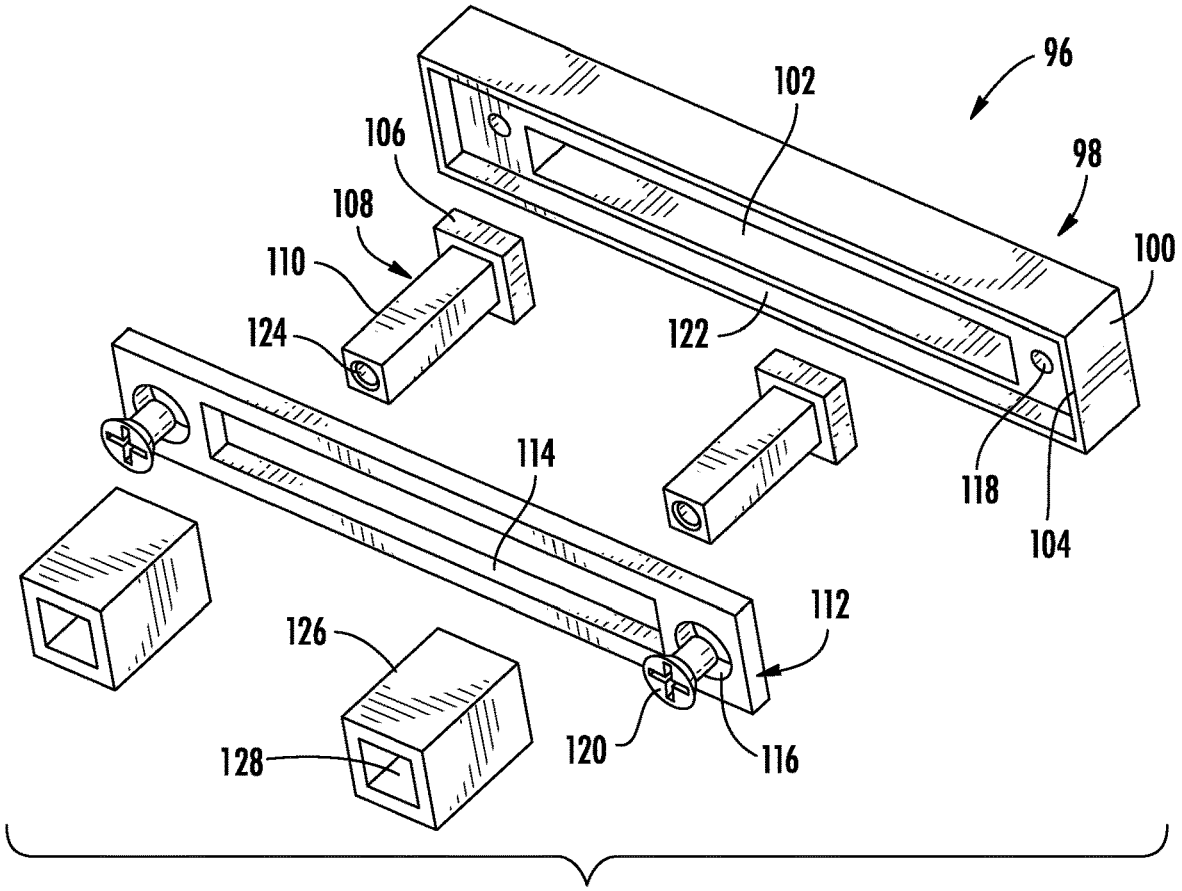
FIG. 10 is a rear exploded perspective view of the handle assembly of FIG. 9.

FIGS. 9 and 10 illustrate a handle assembly 96 according to another embodiment. The handle assembly 96 includes a handle 98 with a body 100. The body 100 has a slot 102 formed into a rear surface 104 to a blind depth. The slot 102 is formed partially along a length of the body 100 and does not extend through the lateral ends of the body 100. The slot 102 also has a consistent width to the depth of the slot 102, without a narrow slot portion.

The width of the slot 102 is sized to receive a head 106 of each of a plurality of fasteners 108. The head 106 of each fastener 108 has a plurality of wrench flats in a square profile to be received in the slot 102, and to resist rotation within the slot 102. The fasteners 108 each include a shank 110 that has an overall width that is less than that of the head 106 of the fasteners 108.

A retainer plate 112 is provided to retain the fasteners 108 to the handle 98. The retainer plate 112 has a slot 114 formed through the plate 112. The slot 114 is sized to permit the shanks 110 of the fasteners 108 to pass through the plate 112. The slot 114 is also sized smaller than the fastener heads 106 so that the retainer plate 112 retains the fastener heads 106 within the handle slot 102. A pair of countersunk apertures 116 are formed through the retainer plate 112, aligned with a pair of threaded apertures 118 in the body 100 of the handle 98. A pair of counter-head screws 120 are received in the retainer plate apertures 116 and the handle apertures 118 to fasten the retainer plate 112 to the handle 98. A recess 122 is formed in the rear surface 104 of the body 100 to receive the retainer plate 112 flush with the rear surface 104 of the body 100.

Distal ends of the shanks 110 of the fasteners 108 abut a mounting surface of the drawer or door. The shanks 110 each include an internally threaded aperture 124 to receive a threaded shank of a screw through a mounting hole in the drawer or the door. The screws can be standard machine screws. Alternatively, the shanks 110 could be externally threaded to engage a nut within the drawer or the door.

A pair of sleeves 126 are each provided about the shank 110 of one of the fasteners 108. Each sleeve 126 is sized to space the handle 98 away from the mounting surface of the drawer or door to permit the user to grasp the body 100 of the handle 98. The sleeves 126 are longer than the portions of the shanks 110 exposed beyond the retainer plate 112. The extra lengths of the sleeves 126 permit the sleeves 126 to be tightened in place as the handle 98 is installed.

In the depicted embodiment, the sleeves 126 are not radially symmetrical. In other words, the sleeves 126 have a polygonal extruded profile, with a square cross section. In order to maintain the sleeves 126 at a consistent aligned rotation, the sleeves 126 each include a radially asymmetrical bore 128 formed therethrough, with a square cross section. Likewise, the shanks 110 of the fasteners 108 also have a square profile to extend through the bores 128 and prevent rotation of the sleeves 126 relative to the fasteners 108. Any sleeve 126 design is contemplated, including asymmetrical and symmetrical profiles.

Figure 11:
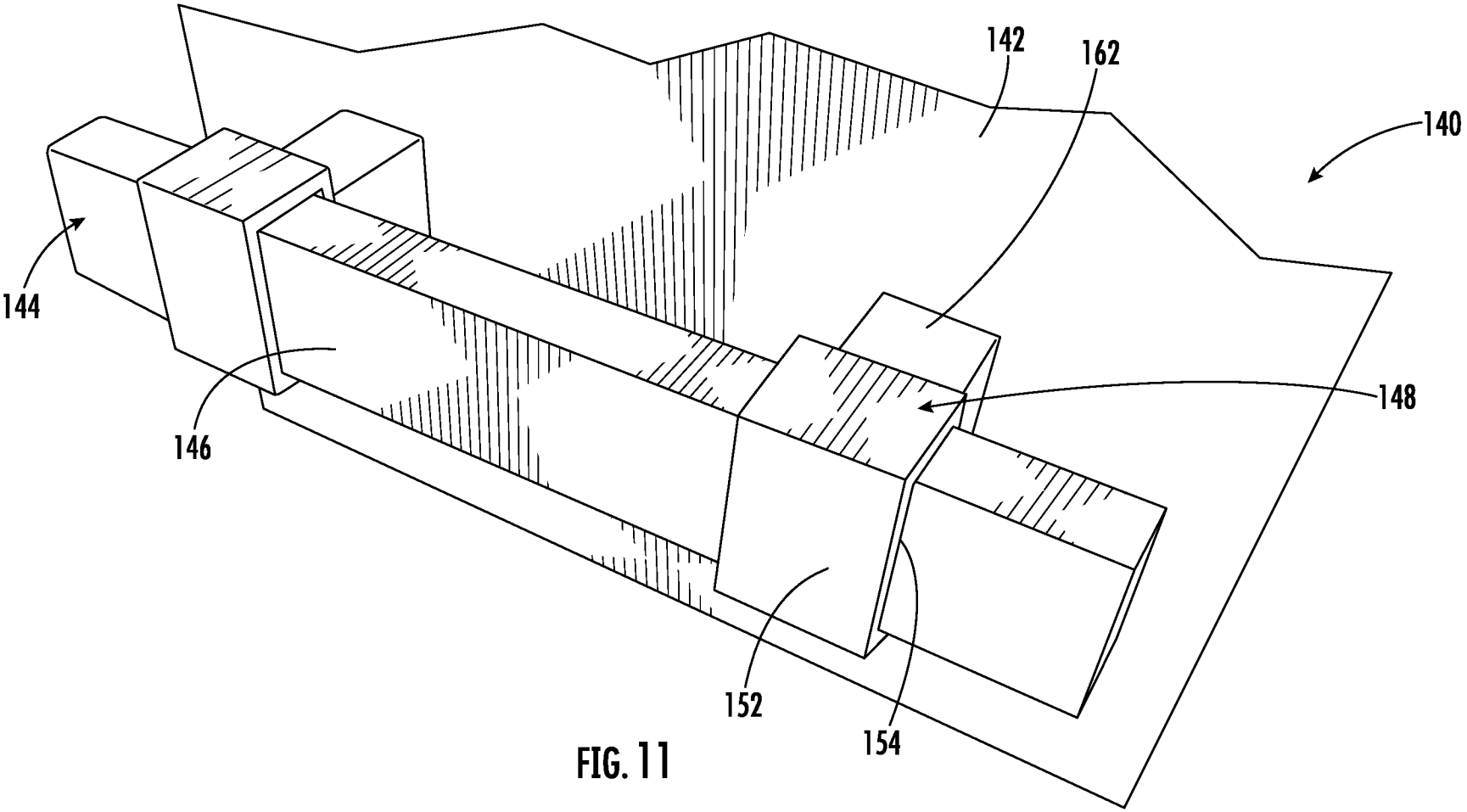
FIG. 11 is a front perspective view of a bar assembly according to another embodiment.
Figure 12:
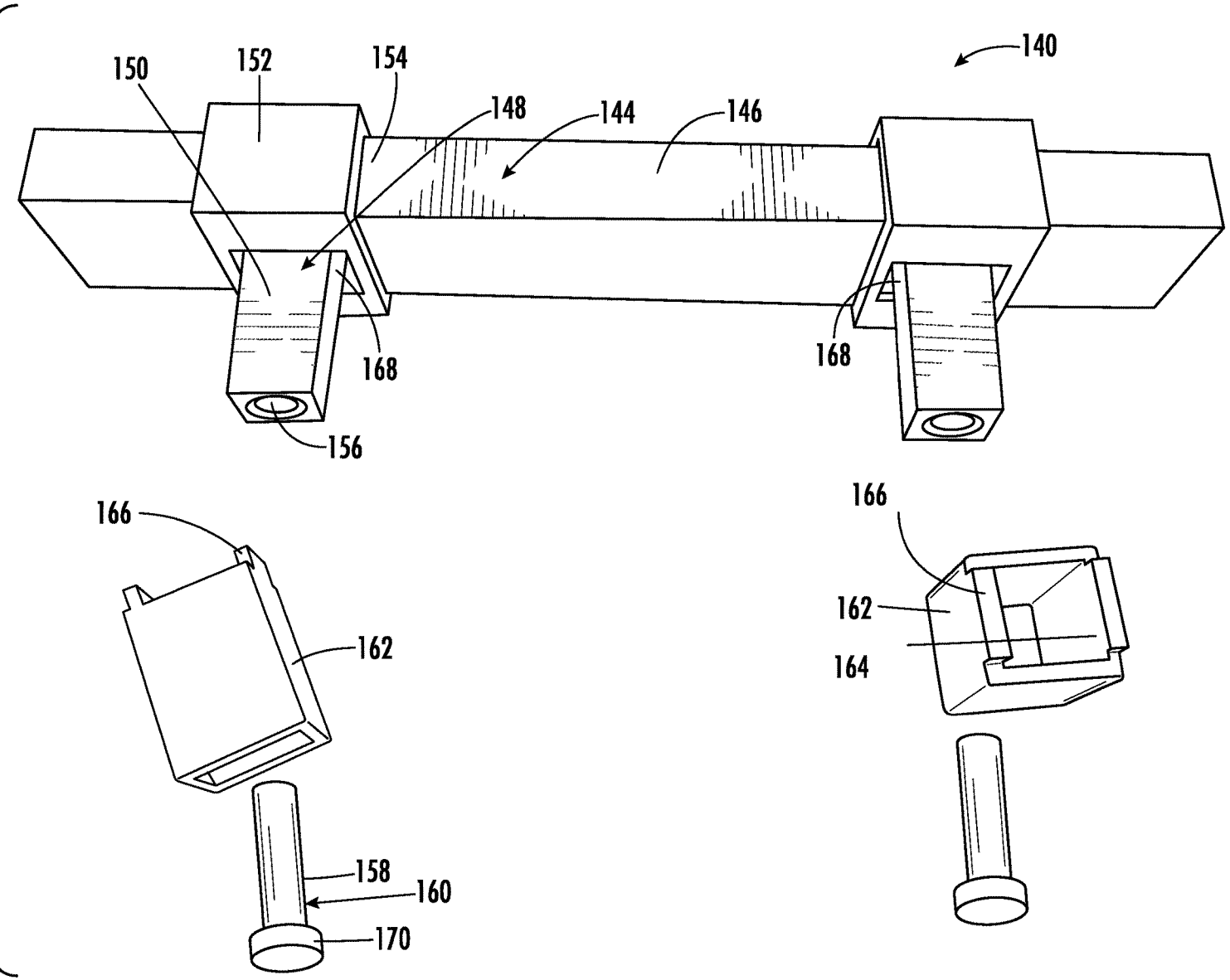
FIG. 12 is a partially exploded top perspective view of the bar assembly of FIG. 11.

FIGS. 11 and 12 illustrate a bar assembly 140 according to another embodiment. The bar assembly 140 may be a handle assembly 140, a towel bar assembly 140, or any suitable adjustable lengthwise bar assembly 140 for mounting to a support surface in a home hardware application. FIG. 11 illustrates the bar assembly installed to a front face 142 of an upright support surface, such as a wall, door or drawer. The bar assembly 140 includes a bar 144 with a body 146 that is sized to be grasped manually. The body 146 has a consistent cross section along a length of the body 146 to act as a guide, instead of a slot of prior embodiments. The cross section is consistent along an entire length of the body 146; however, the consistent cross section could be a portion of the body 146.

The bar assembly 140 includes a plurality of posts 148. The posts 148 each include a body 150 that extends from the bar 144 to the mounting surface of the front face 142. Each post 148 also includes a collar 152 mounted to a distal end of the post 148. Each collar 152 includes a transverse bore 154 formed therethrough and sized to receive the cross section of the body 146 of the bar 144 for translation relative to the bar 144. The collars 152 cooperate with the bar 144 to permit the posts 148 to be aligned with apertures formed in the front face 142 of the support surface.

Proximal ends of the bodies 150 of the posts 148 face the mounting surface of the front face 142. Referring to FIG. 12, the bodies 150 each include an internally threaded aperture 156 so that the posts 148 are also fasteners. The apertures 156 receive a threaded shank 158 of a screw 160 through a mounting hole in the front face 142 (FIG. 11) of the drawer or the door. The screws 160 can be standard machine screws. The screws 160 fasten the posts 148 and the bar 144 to the mounting surface of the front face 142. Alternatively, the bodies 150 can be externally threaded to engage a nut within the drawer or the door.

A second pair of posts, such as sleeves 162, are each provided about the body 150 of one of the posts 148. Each sleeve 162 is sized to space the collars 152, and consequently the bar 144 away from the mounting surface of the front face 142 of the drawer or door to permit the user to grasp the body 146 of the bar 144. The sleeves 162 are longer than the posts 148. The extra lengths of the sleeves 162 permit the sleeves 162 to be held in place by compression as the bar 144 is installed.

In the depicted embodiment, the sleeves 162 are not radially symmetrical. In other words, the sleeves 162 have a polygonal extruded profile, with a square cross section. In order to maintain the sleeves 162 at a consistent aligned rotation, the sleeves 162 each include a radially asymmetrical bore 164 formed therethrough, with a square cross section. Likewise, the bodies 150 of the posts 148 also have a square profile to extend through the bores 164 and prevent rotation of the sleeves 162 relative to the posts 148. Any sleeve 162 design is contemplated, including asymmetrical and symmetrical profiles.

The sleeves 162 also engage the bar 144 to limit translation of the bar 144 and to lock the bar 144 relative to the posts 148. Each sleeve 162 includes a pair of retainer tabs 166 at a distal end of the sleeve 162. Each collar 152 includes a corresponding pair of apertures 168 formed through a side of the collar 152 adjacent to an intersection of the collar 152 with the body 150 of the post 148.

Upon installation of the bar assembly 140, the sleeves 162 are slid over the posts 148. The posts 148 are aligned with apertures in the front face 142 and the bar 144 is slid into the collars 152. The screws 160 are installed with screw heads 170 placed inside the front face 142 with the screw shanks 158 passing through the apertures in the front face 142 into threaded engagement with the apertures 156 in the bodies 150 of the posts 148. The proximal ends of the sleeves 162 engage the front face 142 and the retainer tabs 166 engage the bar 144. As the screws 160 are tightened, the screws 160 pull the distal ends of the posts 148 toward the front face 142 thereby loading the collars 152 upon the bar 144. The loading of the collars 152 upon the bar 144 is distributed from the bar 144 to the sleeves 162 and to the front face 142. Once installed, the posts 148 are in tension upon the bar 144, and consequently, the sleeves 162 are under compression beneath the bar 144, thereby locking the bar 144 in place in the collars 152.

Figure 13:
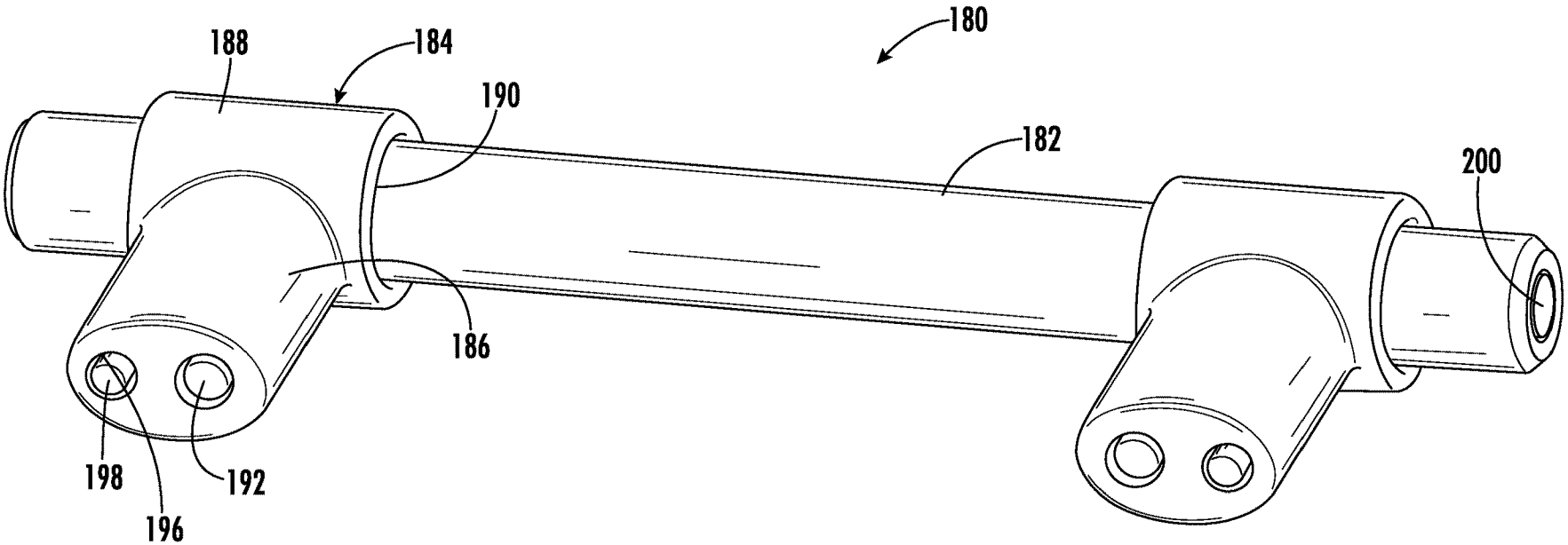
FIG. 13 is a rear perspective view of a bar assembly according to another embodiment.
Figure 14:
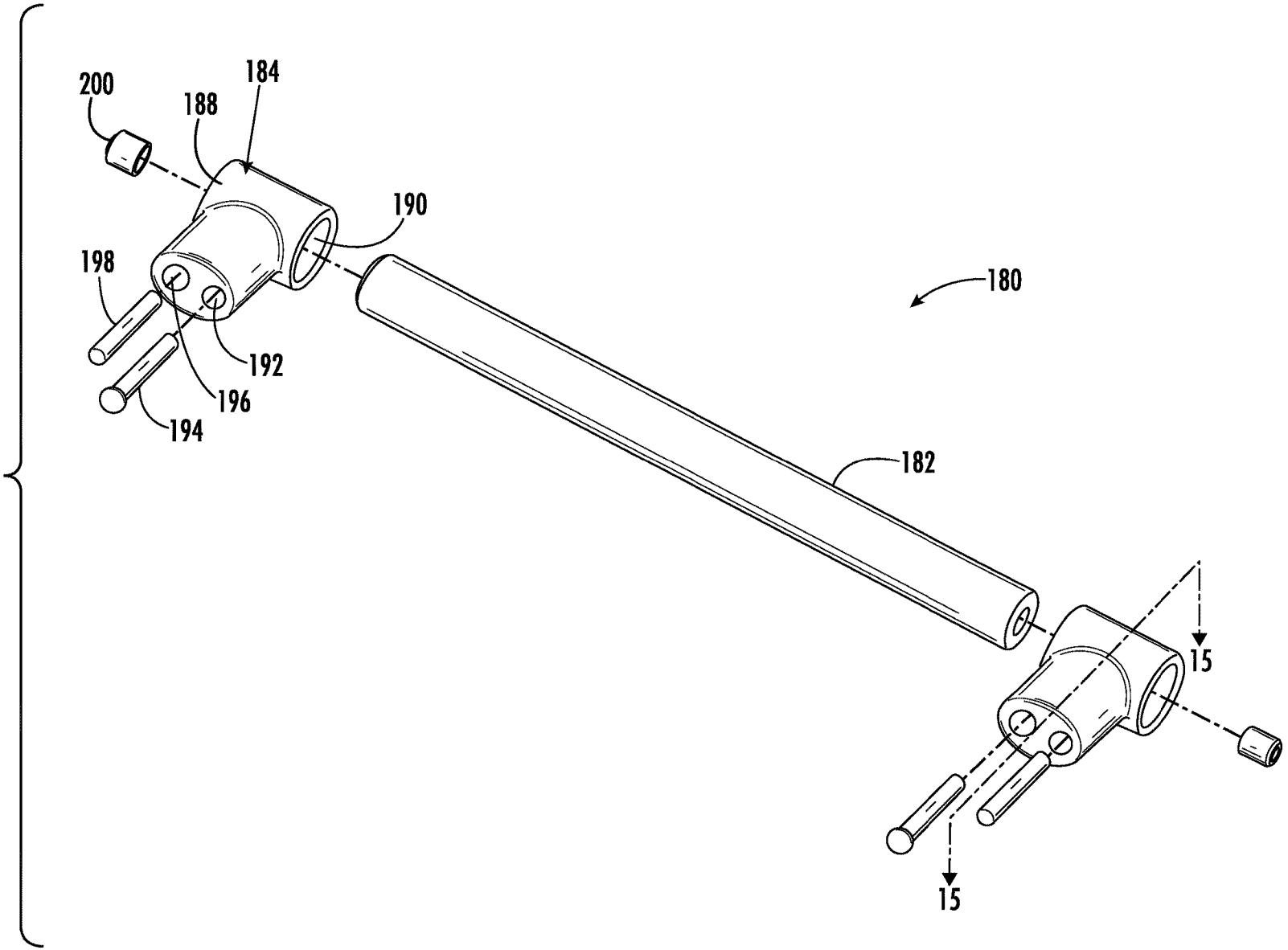
FIG. 14 is an exploded rear perspective view of the bar assembly of FIG. 13.
Figure 15:
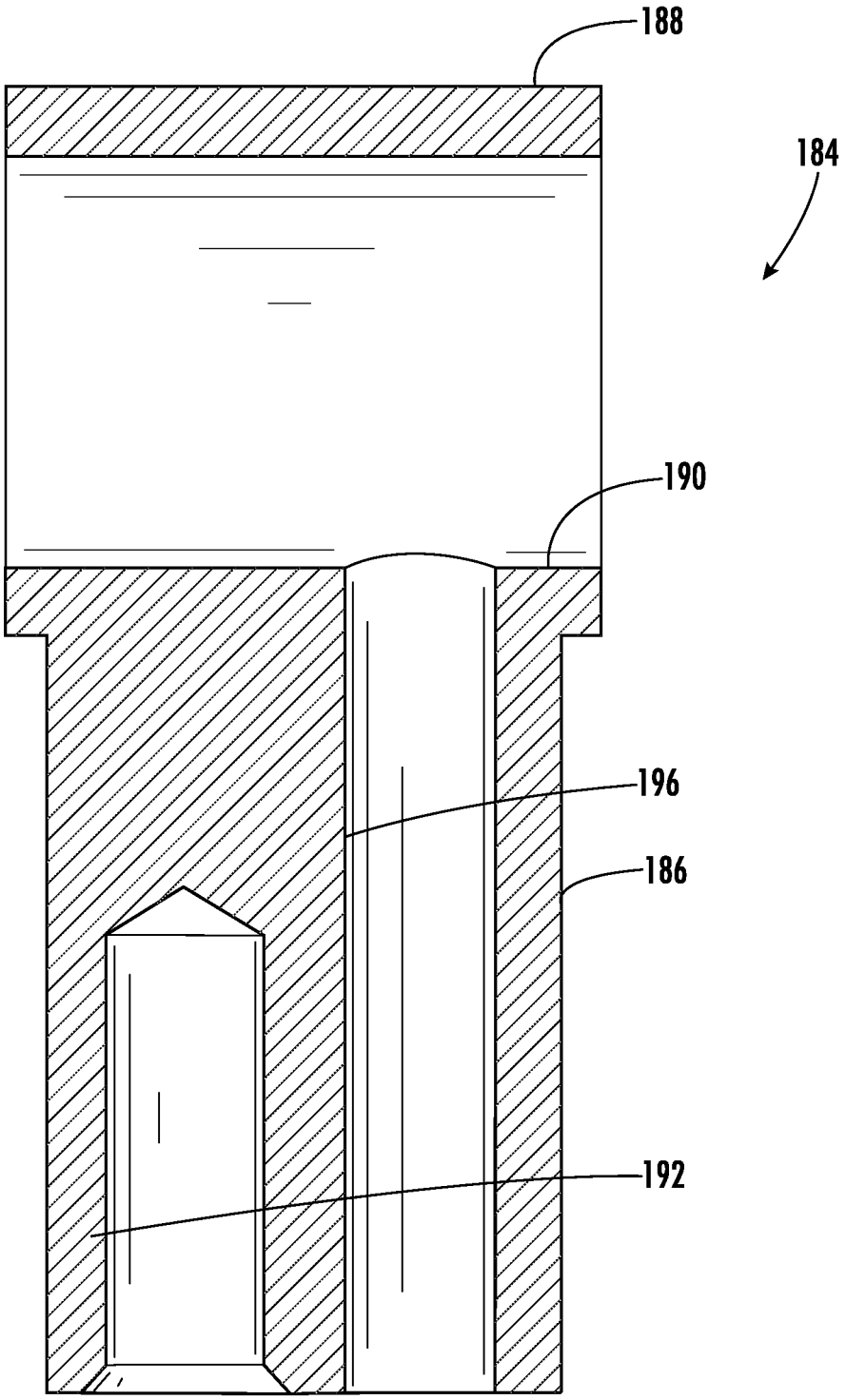
FIG. 15 is a section view of a post of the bar assembly of FIG. 13, taken along section line 15-15 in FIG. 14.

With reference now to FIGS. 13 and 14, a bar assembly 180 is illustrated according to another embodiment. The bar assembly includes a bar or bar 182 with a length and a continuous cross-section. For example, the bar 182 has a round cross-section with a cylindrical overall shape. The bar assembly 180 also includes a pair of posts 184 in cooperation with the bar 182. A cross-section of one of the posts 184 is illustrated in FIG. 15.

Each of the posts 184 includes a body 186 to space the bar 182 away from the support surface. A collar 188 is supported upon a distal end of each post body 186. Each collar 188 provides a through aperture 190 to receive the bar 182 for translation of the post 184 relative to the bar 182 for width adjustment of the posts 184. Each post body 186 includes a threaded aperture 192 for alignment and fastening with a corresponding aperture within the support surface. A threaded fastener 194 is provided to extend through the aperture in the support surface, and to be received within the threaded aperture 192 to fasten the post 184 to the support surface. The sliding engagement of the posts 184 relative to the bar 182 permits the posts 184 to be adjusted relative to the bar 182.

The posts 184 each include a lengthwise through aperture 196 formed through the body 186 of the post 184 and intersecting the bar aperture 190 in the collar 188. Each post 184 is provided with a second post, such as a pin 198, is received within the through aperture 196 in the post body 186. The pins 198 have a length slightly greater than that of the post body 186 to extend into the collar aperture 190 to engage the bar 182. Upon tightening of the threaded fasteners 194, the posts 184 are loaded in tension, and the pins 198 are loaded in compression between the bar 182 and the support surface to lock the bar 182 relative to the posts 184.

The pins 198 may be formed from any suitable compressible material, such as a steel alloy. Marring of the bar 182 by the compressed pins 198 may not be a concern because the pins 198 typically contact a rear, or concealed surface of the bar 182. Alternatively, the pins 198 may be formed from a softer material than the bar 182 to avoid marring a surface of the bar 182. For example, the bar 182 may be formed from metal or wood, and the pins 198 may be formed from a polymeric material. Alternatively, the pins 198 may be formed with polymeric tips.

The bar 182 may be formed hollow with openings for supporting the bar 182 during a plating or coating process. According to an alternative option of the bar assembly 180, the bar assembly may also include a plug 200 to enclose a hollow opening in the bar 182.

Figure 16:
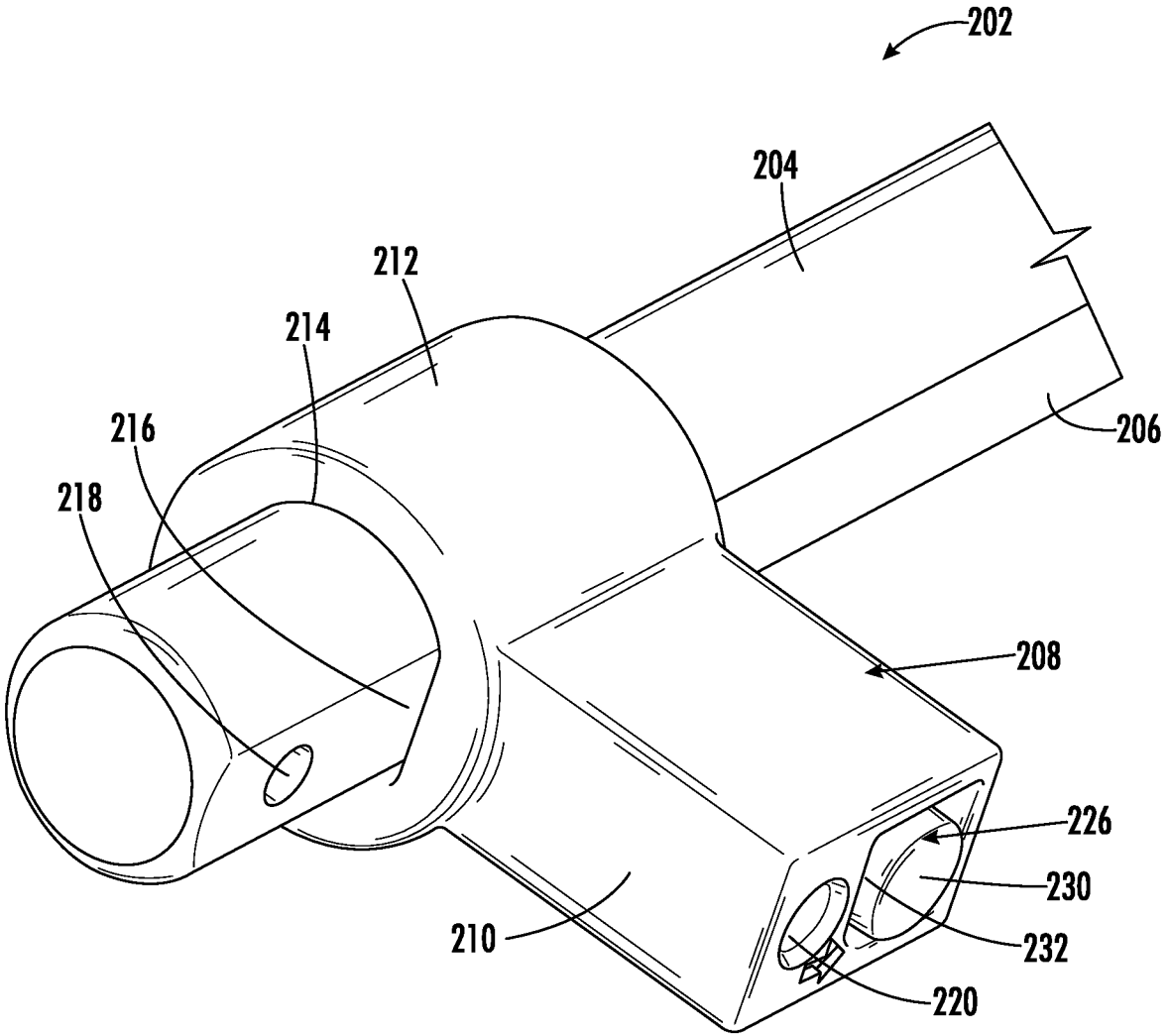
FIG. 16 is a rear perspective view of a portion of a bar assembly according to another embodiment.
Figure 17:
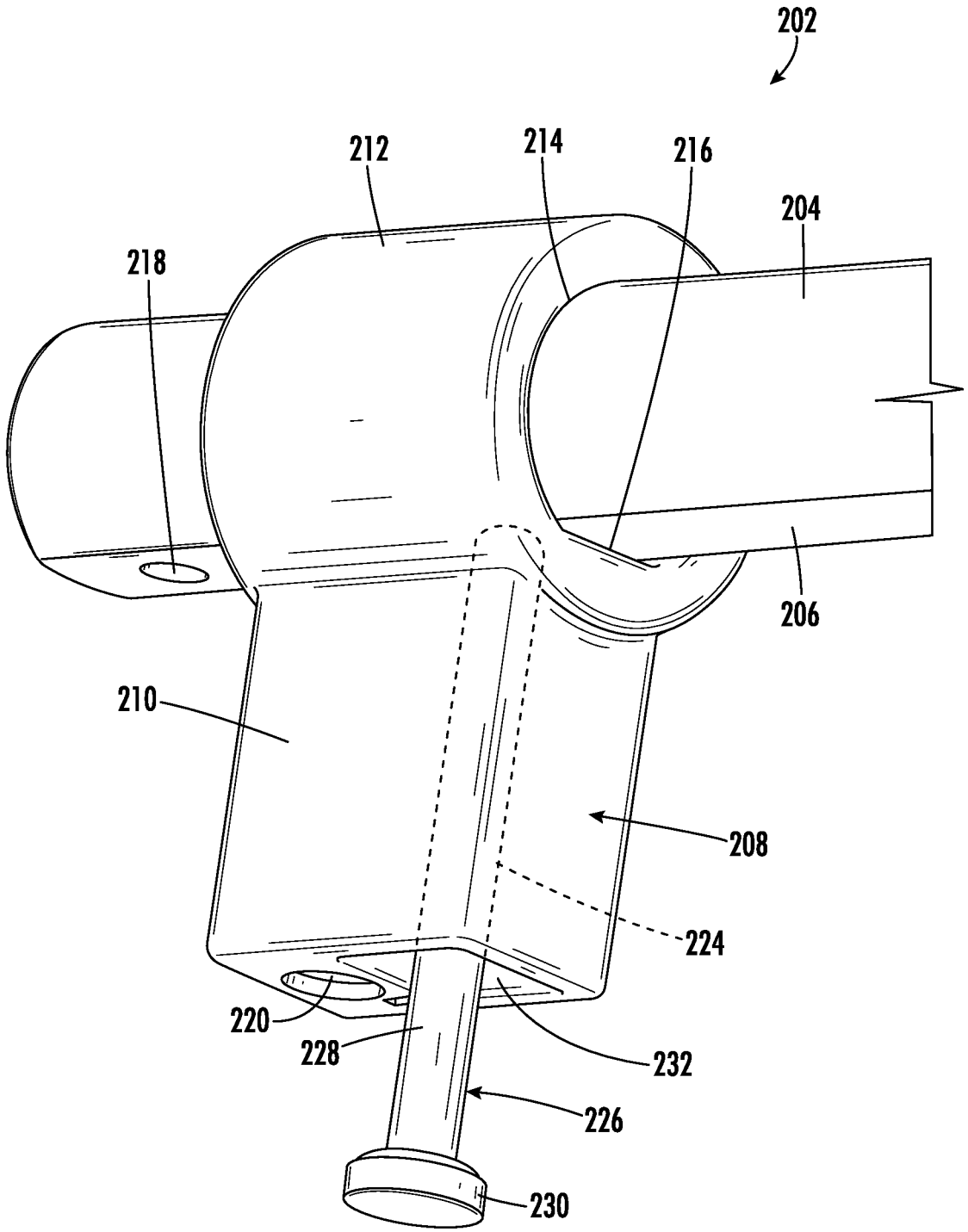
FIG. 17 is a partially exploded top perspective view of the portion of the bar assembly of FIG. 16.

FIGS. 16 and 17 illustrate a bar assembly 202 according to another embodiment. The bar assembly 202 includes a bar 204 with a length and a continuous cross-section. The continuous cross-section of the bar 204 is shaped to prevent rotation of the bar 204. For example, the bar 204 has a round cross-section with a flat portion 206 formed along a surface of the bar 204.

The bar assembly 202 also includes a pair of posts 208 in cooperation with the bar 204. Each of the posts 208 includes a body 210 to space the bar 204 away from the support surface. A collar 212 is supported upon a distal end of each post body 210. Each collar 212 provides a through aperture 214 to receive the bar 204 for lengthwise translation of the post 208 relative to the bar 204 for width adjustment of the posts 208. Each through aperture 214 is shaped to prevent rotation of the bar 204 relative to the collars 212 of the posts 208. For example, each through aperture 214 includes a flat portion 216 that is sized to correspond to the flat portion 206 of the bar 204.

The flat portion 216 of each through aperture 214 in the collars 212 is aligned facing away from the body 210 of the posts 208 so that the flat portion 206 of the bar 204 faces the body 210 of the posts 208. The flat portion 216 of the collars 212 prevents the bar 204 from rotation to maintain the flat portion 206 of the bar 204 away from an ordinary view of the end user to conceal mounting apertures 218, which may be employed to support the bar 204 during a plating process. According to an alternative embodiment, the mounting apertures 218 may be employed to mount additional hardware to the bar assembly 202.

Each post body 210 includes a threaded aperture 220 for alignment and fastening with a corresponding aperture within the support surface. A threaded fastener is provided to extend through the aperture in the support surface, and to be received within the threaded aperture 220 to fasten the post 208 to the support surface. The sliding engagement of the posts 208 relative to the bar 204 permits the posts 208 to be adjusted relative to the bar 204.

As illustrated in FIG. 17, the posts 208 each include a lengthwise through aperture 224 formed through the body 210 of the post 208 and intersecting the bar aperture 214 at the flat portion 216 in the collar 212. FIGS. 16 and 17 depict that each post 208 is provided with a second post, such as a pin 226. With reference to FIG. 17, each pin 226 includes a body 228 that is sized to be received within the through aperture 224 in the post body 210. Referring again to FIGS. 16 and 17, each pin 226 also includes a head 230, which provides an enlarged contact surface for contacting the support surface and to provide a stable engagement with the support surface. The enlarged contact surface of the head 230 distributes the compression load across an enlarged surface to reduce an occurrence of damage or marring of the support surface. A recess 232 is formed into a proximal end of the body 210 of the post 208 and aligned with the through aperture 224 to receive and conceal the head 230 of the pin 226 in the installed position of FIG. 16.

The pins 226 have a length slightly greater than that of the post body 210 to extend into the collar aperture 214 to engage the bar 204 at the flat portion 206. Upon tightening of the threaded fasteners, the posts 208 are loaded in tension, and the pins 226 are loaded in compression between the bar 204 and the support surface to lock the bar 204 relative to the posts 208. The flat portion 206 of the bar 204 provides a smooth, flat surface for the pin 226 to engage the bar 204.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A bar assembly comprising:

a bar sized to be grasped manually with a guide formed at least partially along a length;

a first plurality of posts each in cooperation with the guide of the bar for lengthwise translation of each of the first plurality of posts relative to the bar for width adjustment of the first plurality of posts, to fasten the bar to a support surface; and a second plurality of posts, each sized to cooperate with one of the first plurality of posts to space the bar away from the support surface;

wherein the first plurality of posts is each provided with a lengthwise through aperture;

wherein the second plurality of posts further comprise a plurality of pins, each disposed within one of the lengthwise through apertures, so that when the plurality of first posts is fastened to the support surface, the plurality of pins is under compression between the bar and the support surface; and wherein each of the plurality of pins includes an enlarged surface relative to a body of the pin to contact the support surface to distribute a compression load upon the support surface.

2. The bar assembly of claim 1 wherein the fastened first plurality of posts apply compression to the second plurality of posts between the support surface and the bar or the first plurality of posts.

3. The bar assembly of claim 2 wherein the fastened first plurality of posts are under tension to apply compression to the second plurality of posts.

4. The bar assembly of claim 1 wherein the second plurality of posts each has a length greater than that of the corresponding first post.

5. The bar assembly of claim 1 further comprising a plurality of fasteners sized to engage a body of each of the first plurality of posts to fasten the bar to the support surface, wherein the plurality of fasteners tightens the first plurality of posts against the bar to lock the first plurality of posts along the guide.

6. The bar assembly of claim 5 wherein the body of each of the first plurality of posts is internally threaded; and wherein each of the plurality of fasteners is externally threaded and sized to be received in the internally threaded bodies of the first plurality of posts.

7. The bar assembly of claim 5 wherein the body of each of the first plurality of posts includes an internally threaded aperture spaced apart from the lengthwise through aperture.

8. The bar assembly of claim 1 wherein each of the first plurality of posts comprises a body to space the bar away from the support surface.

9. The bar assembly of claim 1 wherein each of the plurality of pins further comprises an enlarged head relative to the body of each pin; and wherein a recess is formed into a proximal end of a body of each post and aligned with the through aperture to receive and conceal the head of the corresponding pin.

10. A bar assembly comprising:

a bar sized to be grasped manually with a guide formed at least partially along a length; and a plurality of posts each in cooperation with the guide of the bar, to fasten the bar to a support surface;

wherein the guide is further defined as a consistent cross section formed along the length of the bar; and a plurality of collars, each affixed to a distal end of one of the plurality of posts, wherein each collar is sized to receive the cross section of the bar therein for linear adjustment of the plurality of collars relative to the bar; and wherein each of the plurality of collars provides a through aperture to receive the bar for lengthwise translation of each post relative to the bar for width adjustment of the posts.

11. The bar assembly of claim 10 wherein the consistent cross section is shaped to prevent rotation of the bar relative to the plurality of posts.

12. The bar assembly of claim 11 wherein the bar has a flat portion formed along a surface of the bar to prevent rotation of the bar relative to the plurality of posts.

13. The bar assembly of claim 10 wherein each collar through aperture is shaped to prevent rotation of the bar relative to the collars of the posts.

14. The bar assembly of claim 13 wherein each collar through aperture includes a flat portion to prevent rotation of the bar relative to the collars of the posts.

15. The bar assembly of claim 14 wherein the plurality of collars is each affixed to the distal end of a body of one of the plurality of posts; and wherein each flat portion is aligned facing away from the body of the corresponding post.

16. The bar assembly of claim 10 wherein each through aperture is further defined as a first through aperture; and wherein each of the plurality of posts is provided with a second through aperture formed lengthwise therethrough intersecting the corresponding first through aperture.

17. The bar assembly of claim 16 wherein the plurality of posts is further defined as a first plurality of posts; and wherein the bar assembly further comprises a second plurality of posts, each disposed within one of the second through apertures, so that when the plurality of first is fastened to the support surface, the second plurality of posts extends into first through aperture to engage the bar.

18. The bar assembly of claim 17 wherein the fastened first plurality of posts are in tension and apply compression to the second plurality of posts between the bar and the support surface.

19. A bar assembly comprising:

a bar sized to be grasped manually with a guide formed at least partially along a length;

a first plurality of posts each in cooperation with the guide of the bar to fasten the bar to a support surface; and a second plurality of posts, each sized to cooperate with one of the first plurality of posts to space the bar away from the support surface;

wherein the first plurality of posts is each provided with a lengthwise through aperture; and wherein the second plurality of posts further comprise a plurality of pins, each disposed within one of the lengthwise through apertures, and each having a length greater than that of the corresponding first post, so that when the plurality of first posts is fastened to the support surface, the plurality of pins is under compression between the bar and the support surface.

20. The bar assembly of claim 19 wherein each of the plurality of pins includes an enlarged surface relative to a body of the pin to contact the support surface to distribute a compression load upon the support surface.

* * * * *